US009358566B2

(12) United States Patent
Kapsner et al.

(10) Patent No.: US 9,358,566 B2
(45) Date of Patent: Jun. 7, 2016

(54) IN-LINE PRETREATMENT SYSTEM FOR MACHINE PARTS

(75) Inventors: John Gregory Kapsner, Mankato, MN (US); Theodore Lowell Schreyer, Mankato, MN (US); Kelly Gordon McCabe, Le Center, MN (US)

(73) Assignee: PEM, Inc., Mankato, MN (US)

( * ) Notice: Subject to any disclaimer, the term of this patent is extended or adjusted under 35 U.S.C. 154(b) by 906 days.

(21) Appl. No.: 13/475,756

(22) Filed: May 18, 2012

(65) Prior Publication Data

US 2013/0306114 A1 Nov. 21, 2013

(51) Int. Cl.

| | |
|---|---|
| ***B05B 15/12*** | (2006.01) |
| ***B08B 3/04*** | (2006.01) |
| ***B08B 3/02*** | (2006.01) |

(52) U.S. Cl.

CPC ..... *B05B 15/1214* (2013.01); *B05B 15/1288* (2013.01); *B05B 15/1296* (2013.01); *B08B 3/022* (2013.01); *B08B 3/041* (2013.01)

(58) Field of Classification Search

CPC ..... B08B 3/022; B08B 3/041; B08B 3/123; B05B 15/12; B05B 15/1259; B05B 15/1214; B05B 15/1288; B05B 15/1296; B05B 15/1203; B05B 15/0443

USPC ..... 134/122 R, 135, 140, 151, 143, 61, 76, 134/72, 131, 199, 200; 312/228; 118/634, 118/635, 326

See application file for complete search history.

(56) References Cited

U.S. PATENT DOCUMENTS

| | | | | |
|---|---|---|---|---|
| 2,547,884 A | | 4/1951 | Paasche | |
| 3,942,420 A | * | 3/1976 | Marino | B05B 15/1229 118/326 |
| 3,960,323 A | | 6/1976 | Ducan et al. | |
| 4,327,756 A | | 5/1982 | Rath | |
| 4,381,794 A | | 5/1983 | Stimac et al. | |
| 4,924,803 A | * | 5/1990 | Celant | B05B 15/1211 118/308 |
| 5,000,985 A | | 3/1991 | Salisbury | |
| 5,253,665 A | | 10/1993 | Guirl | |
| 5,257,739 A | | 11/1993 | Pascaru | |
| 5,259,879 A | * | 11/1993 | Khattab | B05B 15/0418 118/309 |
| 5,264,037 A | | 11/1993 | Salisbury | |
| 5,443,642 A | | 8/1995 | Bienduga | |
| 5,564,159 A | * | 10/1996 | Treiber | 15/302 |
| 5,582,440 A | | 12/1996 | Pascaru | |

(Continued)

FOREIGN PATENT DOCUMENTS

| | | | | |
|---|---|---|---|---|
| SE | WO 9208549 A1 | * | 5/1992 | B05B 15/1214 |
| WO | WO 2005068269 A1 | * | 7/2005 | |

*Primary Examiner* — Michael Barr
*Assistant Examiner* — Kevin G Lee
(74) *Attorney, Agent, or Firm* — Nikolai & Mersereau, PA; Thomas J. Nikolai

(57) ABSTRACT

An in-line parts washing system comprising concatenated modules of two discrete lengths where certain of the modules have a self-contained tank of parts cleaning chemical along with a motor-driven pump for forcing the cleaning chemical through spray heads enclosed in a shroud through which the parts to be cleaned are transported via a conveyor. Other modules disposed in-line with the wash modules provide zones where the cleaning chemical dripping from the parts is collected and redirected back into the tanks from which it originated. The ability to swap modules of differing length allows a user to easily alter the cleaning process.

13 Claims, 13 Drawing Sheets

(56) References Cited

U.S. PATENT DOCUMENTS

| | | | | |
|---|---|---|---|---|
| 5,630,435 | A * | 5/1997 | Brouchoud | B08B 3/006 134/183 |
| 5,758,674 | A * | 6/1998 | Taeger | B08B 15/02 134/122 R |
| 6,120,604 | A | 9/2000 | Hawkins | |
| 6,675,066 | B2 | 1/2004 | Moshgbar | |
| 2007/0224343 | A1 | 9/2007 | Langlois | |
| 2009/0277384 | A1 | 11/2009 | Spangler et al. | |
| 2010/0008749 | A1 | 1/2010 | Spangler et al. | |

* cited by examiner

IN-LINE PRETREATMENT SYSTEM FOR MACHINE PARTS

BACKGROUND OF THE INVENTION

I. Field of the Invention

This invention relates generally to apparatus for industrial pre-cleaning of machine parts prior to painting or powder coating of such parts, and more particularly to a multi-stage, in-line washer whereby parts to be cleaned are subjected to a pressurized spray at elevated temperatures of chemical cleaning solutions for predetermined time periods determined by the number of stages employed.

II. Discussion of the Prior Art

As explained in the Pascaru U.S. Pat. No. 5,257,739, machined parts must be chemically cleaned to remove oils and other residues therefrom before painting or powder coating operations can be performed on these parts. Spraying equipment used to clean, rinse and otherwise treat articles of manufacture take place in a confined area, such as a spray or washer booth, in which various liquids are piped under pressure through headers into a plurality of vertical pipes, called risers, that connect to the headers and then out through nozzles attached to the risers and which are adapted to forcefully spray work pieces as they pass through the washer booth being transported by an overhead conveyor or other suitable transport mechanism.

As further explained, prior art washer booths are customarily made of steel and are equipped with a pair of header pipes that are spaced apart and that run parallel and longitudinal to the floor or ceiling of the washer booth. Industrial liquids are stored in a tank beneath the washer booth floor and are pumped through suitable plumbing to the headers. A bank of plastic or steel risers is connected to each header and extends upward or downward along an adjacent wall of the washer booth depending on the header's placement. Parts to be treated may be carried through the booth and exposed to chemical spray by a suitable conveyor.

Pretreatment systems have four major process requirements needed to affect suitable parts cleaning. They are:

Temperature of the bath;

Concentration of the chemistry in the bath;

Pressure of the liquid spray on the part (impingement);

Time in each wash stage.

The concentration, pressure and temperature are capable of adjustment once the washer is built, but after a washer has been built; the exposure time is fixed, based on the length dimension of the washer and each of its stages.

For example, assume a company has designed to run a conveyor of the parts to be cleaned at 4 feet per minute and that three process stages are required. Three process stages typically require two drip zones, one entrance and one exit vestibule with a 1 minute soak time required in each stage. Under these assumptions, a wash booth would have to be 28 feet in length. Over time, should the company decide to increase the conveyor speed to add throughput, it would have to sacrifice soak time or, alternatively, add length to the washer, usually at considerable expense. Also, if the company needs to add another stage to improve its process or possibly add another type of process, it will not be able to do that without substantial added cost. In the case of the prior art, it is a major project to add length to a washer or to shorten it.

Existing washers of which we are aware typically occupy a significant amount of factory floor space and are inefficient in terms of energy needed to pump and heat the liquid cleaning agents.

Those skilled in the art, then, can appreciate that a need exists for an in-line pretreatment system that is modular in design, allowing stages to be easily added or removed based upon customer requirements.

Another problem with prior art parts washer booths is that they do not permit easy access to the piping system comprising the nozzles, risers and headers contained within the booth so that adjustments may be made to the direction and spray pattern employed. Thus, a need exists for an in-line pretreatment system that allows easy access to interior components for cleaning, adjustment repair and replacement.

Another drawback of prior art washers is that they need some type of filtration system in the first wash stage to help keep the bath clean so as to offer an extended bath life. The filtration systems commonly employed require an additional pump and bag filtration system typically placed adjacent to the washer. Such filtration systems therefore require additional energy and floor space. A need therefore exists for a more compact and energy efficient way for filtering the wash chemicals.

It is therefore a principal object of the present invention to provide an in-line pretreatment system for washing machine parts that solves the aforementioned problems attendant in known prior art systems by providing a modular configuration of different length stages that can be concatenated to vary the time of exposure and the types of chemicals needed for the cleaning process at hand. The modules have been specifically designed to provide greater flexibility and ease of access to interior components while also reducing the overall footprint and energy consumption needed to operate the system.

SUMMARY OF THE INVENTION

A pre-washer assembly for use with an overhead conveyor that is adapted to carry machine parts through the pre-washer assembly for cleaning prior to their being painted or powder coated comprises a plurality of concatenated wash stages where each wash stage includes a base frame assembly having a motor-driven pump mounted thereon and also supporting a generally rectangular tank. The tank itself has opposed sidewalls and end walls that extend upward from a closed bottom wall to define an open top. The tank is adapted to hold a cleaning liquid supply therein. First and second upright assemblies are attached individually to the opposed sidewalls of the tank and each of the upright assemblies includes a plurality of inverted, L-shaped uprights that are held in parallel, spaced-apart relation by horizontally extending cross-members. The upper legs of the uprights affixed to the opposed sidewalls of the tank extend toward one another but with a gap between opposed ends of the inverted L-shaped uprights. First and second roll formed plastic shrouds removably attach to the first and second upright assemblies, forming a cabinet-like structure partially surrounding horizontally extending headers and upwardly extending riser pipes to which plural spray nozzles are joined. A motor-driven pump, preferably a centrifugal pump, is arranged to draw the cleaning liquid from the tank and supply it via the headers to the risers and nozzles.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
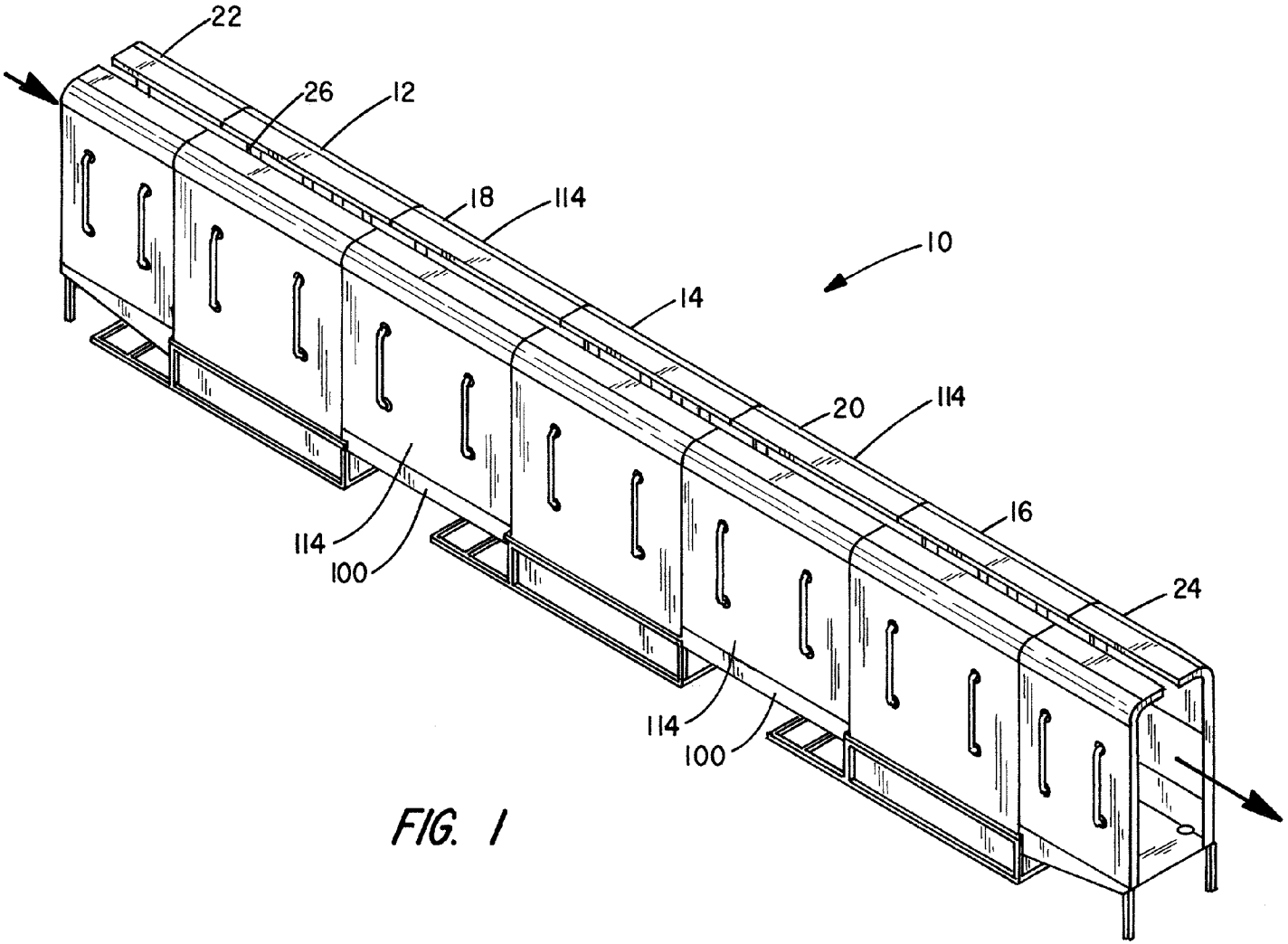
FIG. 1 is a perspective view of a preferred embodiment of the present invention.

This description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

Referring first to FIG. 1, there is indicated generally by numeral 10 the configuration of an in-line pretreatment system for cleaning machine parts constructed in accordance with a first embodiment of the present invention. It is seen to comprise a plurality of concatenated wash stages or modules 12, 14 and 16 with intermediate drip modules 18 and 20. Product to be cleaned is made to enter the pretreatment system of FIG. 1 via an entry stage 22 and to leave via the exit stage 24. Each of the identified modules is constructed so as to have a longitudinally extending gap centrally located in a top portion of each module. The assembly of FIG. 1 is adapted to be positioned directly below an overhead chain conveyor from which parts to be cleaned are suspended from chain linkages that extend vertically through the gaps 26. The size of the part or the rack on which plural parts may be mounted is limited only by the height and width dimension of the modules and the placement of riser pipes there within.

Without limitation, the wash stages or modules 12, 14 and 16 may be produced in two sizes, i.e., they may have an overall length dimension of about 4 feet or 6 feet. Likewise, the drip modules 18 and 20 may also be made in both 4 feet and 6 feet lengths. The entry module 22 and the exit module 24 will typically be 4 feet in length. By providing washer modules in 4 foot or 6 foot increments, stages can be assembled to equal 4, 6, 8, 10 and 12 foot zones. The entrance and exit modules 22 and 24 and the drip zones 18 and 20 serve to contain the spray and keep the cleaning liquid in the proper stages as the parts are carried through the washer by the overhead conveyor (not shown). As will be further explained, when two wash stages are to be joined to one another in directly adjacent relation, a narrow drip stage is used to collect overspray or splash and return it to the tank of a wash stage.

Figure 2:
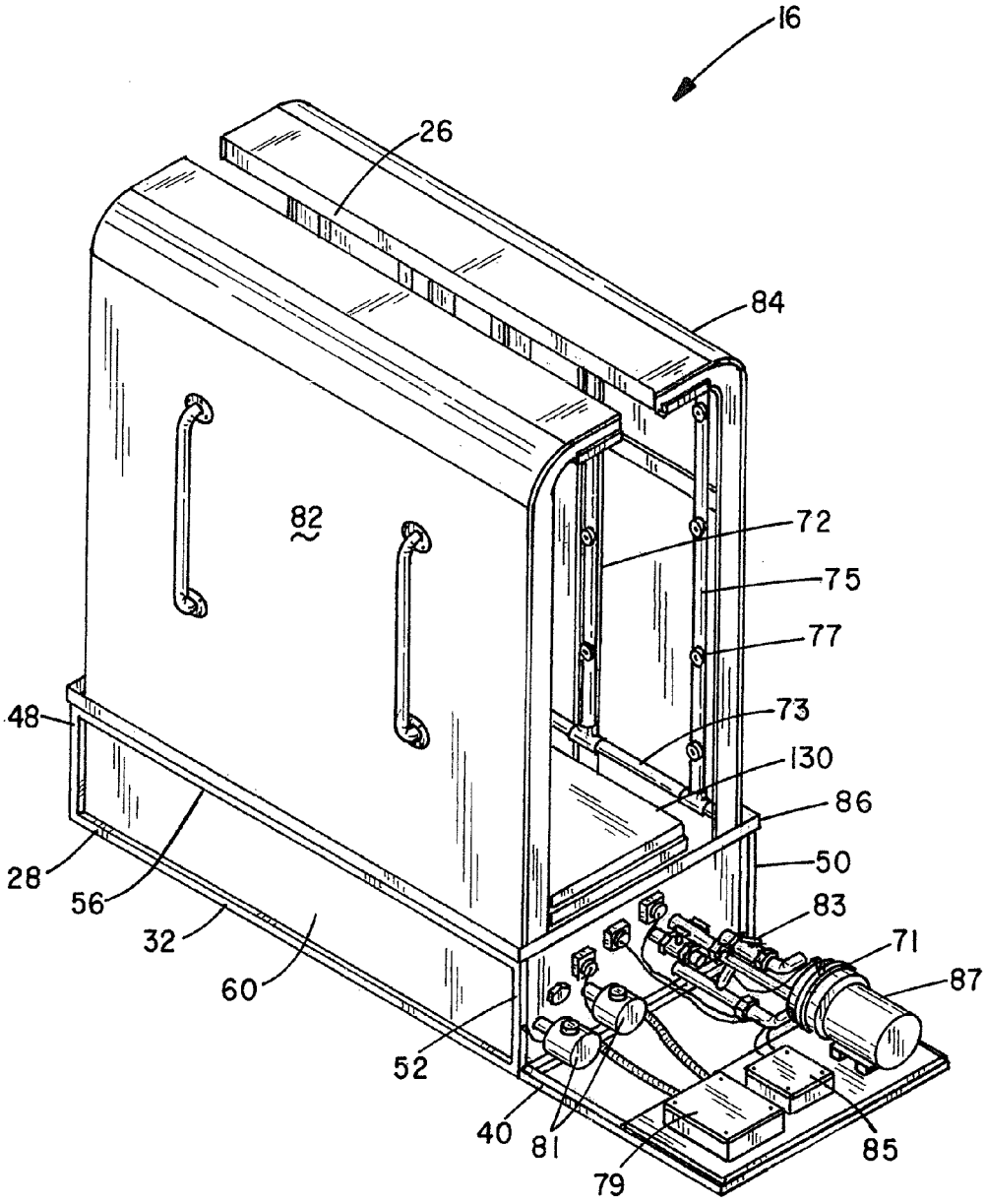
FIG. 2 is a perspective view of one washer stage of the multi-stage embodiment of FIG. 1.
Figure 3:
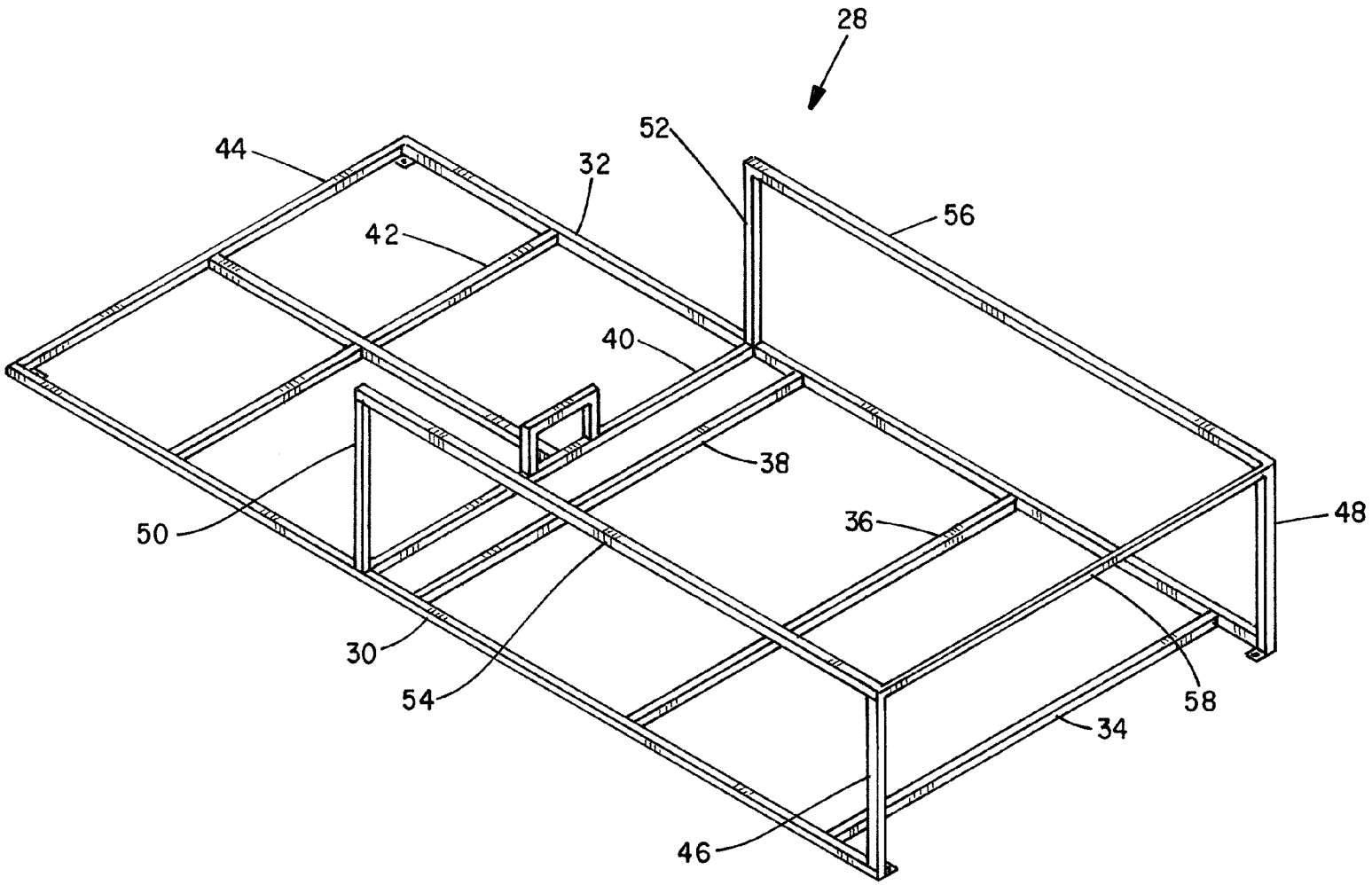
FIG. 3 is a perspective view of the base frame assembly used in implementing the module of FIG. 2.

FIG. 2 is a perspective view of one of the wash stages used in the embodiment of FIG. 1. It is seen to comprise a base frame assembly 28, the constructional features of which are best seen in the perspective view of FIG. 3. The base frame assembly 28 is preferably formed from 1 in.×1 in. 11-gauge stainless steel tubing and includes left and right side rails 30 and 32 that are held in parallel, spaced-apart relation by a plurality of transversely extending cross rails 34, 36, 38, 40, 42 and 44. Projecting up from the side rails 30 and 32 are posts 46 and 48. Like posts 50 and 52 also project upward from the side rails 30 and 32 at their juncture with the ends of the cross bar 40. A pair of shorter side rails 54 and 56 is welded in place between the upper ends of the posts 46, 50 and 48, 52 as illustrated. An upper cross bar 58 also extends between the upper ends of the posts 46 and 48.

As seen in FIG. 2, a tank 60 is designed to drop into the base frame assembly 28. Details of the tank 60 are illustrated in the perspective view of FIG. 4. The tank 60 is preferably fabricated from ½ in. thick copoly elastomer which exhibits high impact strength, some flexibility and resistance to chemical attack from cleaning liquids employed. With a base frame 28 designed for use in a 6 ft. long washer module, the tank may measure 73 in. by 37 in. allowing it to hold approximately 180 gallons of liquid. Similarly, for a washer module of 4 ft. length, the tank may be 49 in. long and 37 in. wide and will hold approximately 120 gallons of cleaning liquid.

Figure 4:
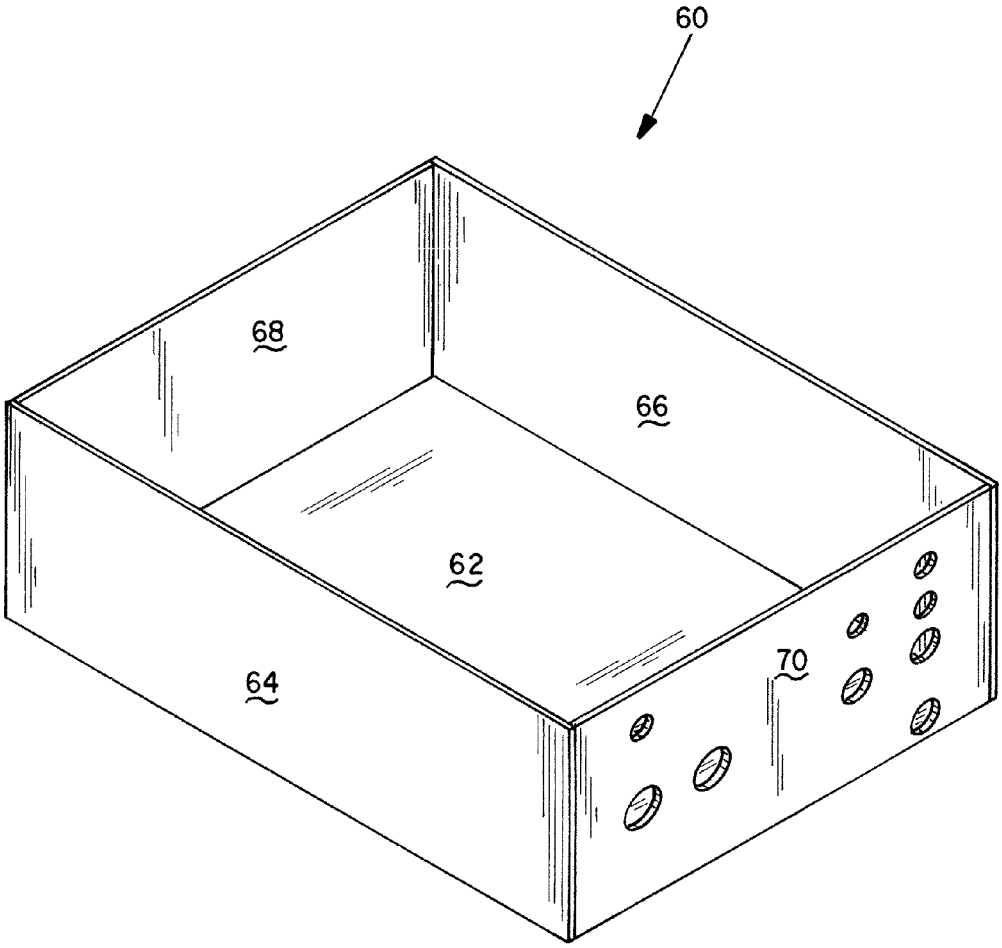
FIG. 4 is a perspective view of a tank used in the embodiment of FIG. 2.

As seen in FIG. 4, the tank 60 has a bottom or floor 62 with mutually perpendicular sidewall 64 and 66 and end walls 68 and 70. While not visible in the view of FIG. 4, the bottom surface 62 is made to slope downward in extending from the end wall 68 to the front wall 70. Formed through the front wall 70 is a plurality of apertures, allowing plumbing connections to be made between the tank interior and the inlet to a motor-driven pump 71, preferably a centrifugal pump, seen in FIG. 2. Plumbing connections are also made from the pump's outlet port through apertures in the wall 70 to manifolds 73, called headers, also visible in FIG. 2, that extend along the module's two opposed sidewalls. Projecting vertically upward from the pair of headers and in fluid communication therewith are a plurality of parallel, spaced-apart riser tubes 75 on which nozzles, as at 77, are disposed for producing jets of cleaning solution drawn from the tank at pressures in a range of 5-30 psi and onto parts to be cleaned that are being conveyed through the wash stage 16.

Other apertures are formed through the front wall of the tank to accommodate electrical controls 79 leading to immersible heater modules 81 disposed within the tank 60 for controlling the temperature of the cleaning liquid. Alternatively, an external gas heater and pump may be used to feed heated cleaning elements to the tank. Also, a drain aperture is provided in which a gate valve 83 is placed to allow dirty fluid to be periodically drained from the tank. Enclosure 85 contains control circuitry for the pump motor 87.

Figure 5:
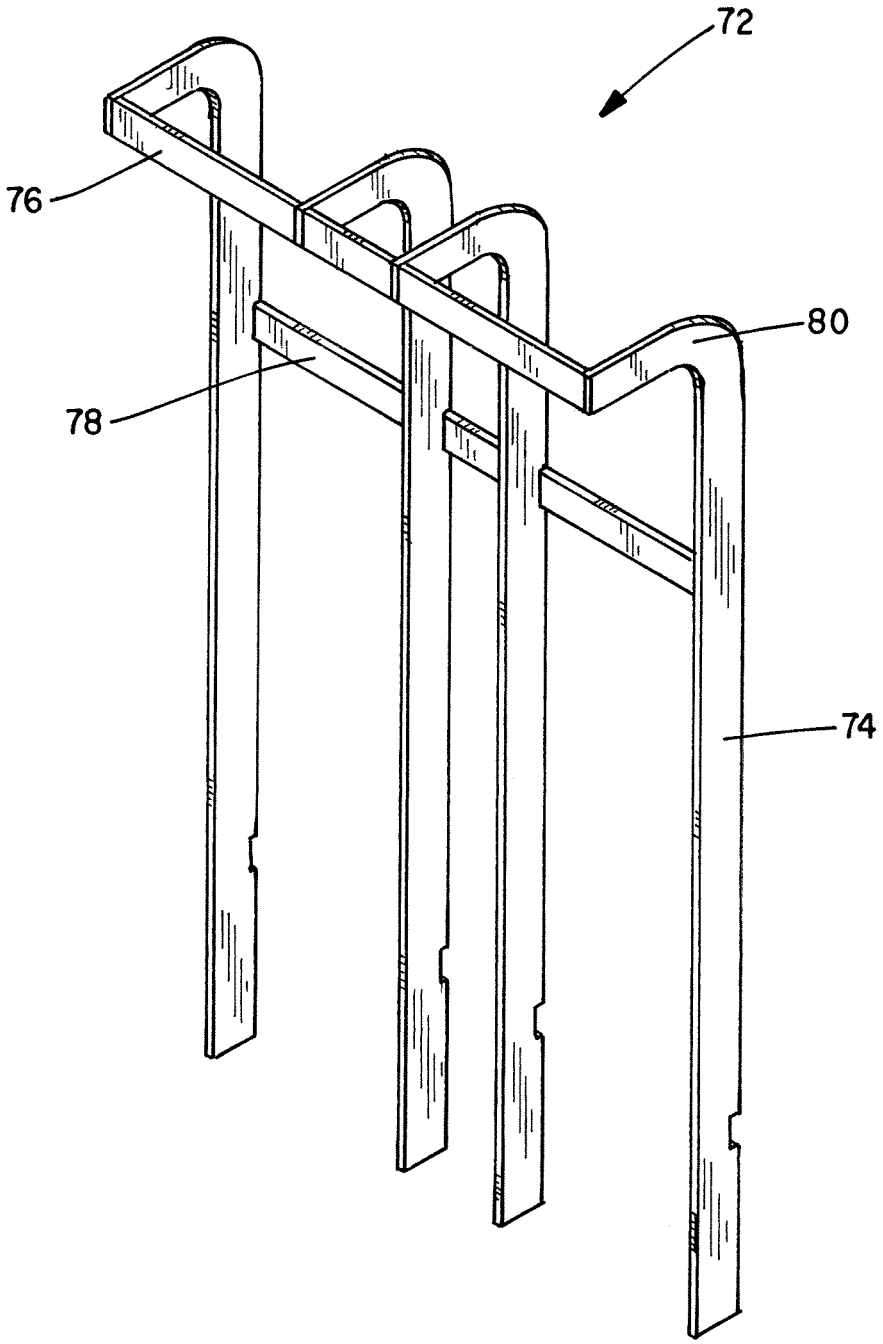
FIG. 5 is a perspective view of a welded upright assembly used in the fabrication of the module of FIG. 2.

Chemically welded or otherwise bonded to the opposed sidewalls 64 and 66 of the tank are upright assemblies 72, a portion of which can be seen in FIG. 2. The perspective view of FIG. 5 shows one of the upright assemblies before its being affixed to the tank side wall. As seen in FIG. 5, the upright assembly 72 comprises a plurality of inverted L-shaped uprights, as at 74, held in parallel, spaced-apart relation by cross members 76 and 78. The upright assemblies 72 are also preferably formed from ¾ in. thick copoly elastomer and when a pair of these assemblies 72 are welded to the side walls of the tank 60, the upper legs, as at 80, extend toward one another across the width dimension of the tank while leaving a gap 26 (FIG. 2) between the ends of the upper legs 80 on the pair of upright assemblies.

The upright assemblies 72 are designed to support first and second spray shrouds 82 and 84. The bottom edge of each of the shroud members 82, 84 is suspended over a drip edge member 86 that rests upon the upper portion of the tank 60 and that has a flange extending over the peripheral edges of the tank 60 such that sprayed liquid running down the inside walls of the spray shrouds 82 and 84 will flow onto the drip edge member 86 and flow back into the tank 60.

Figure 5A:
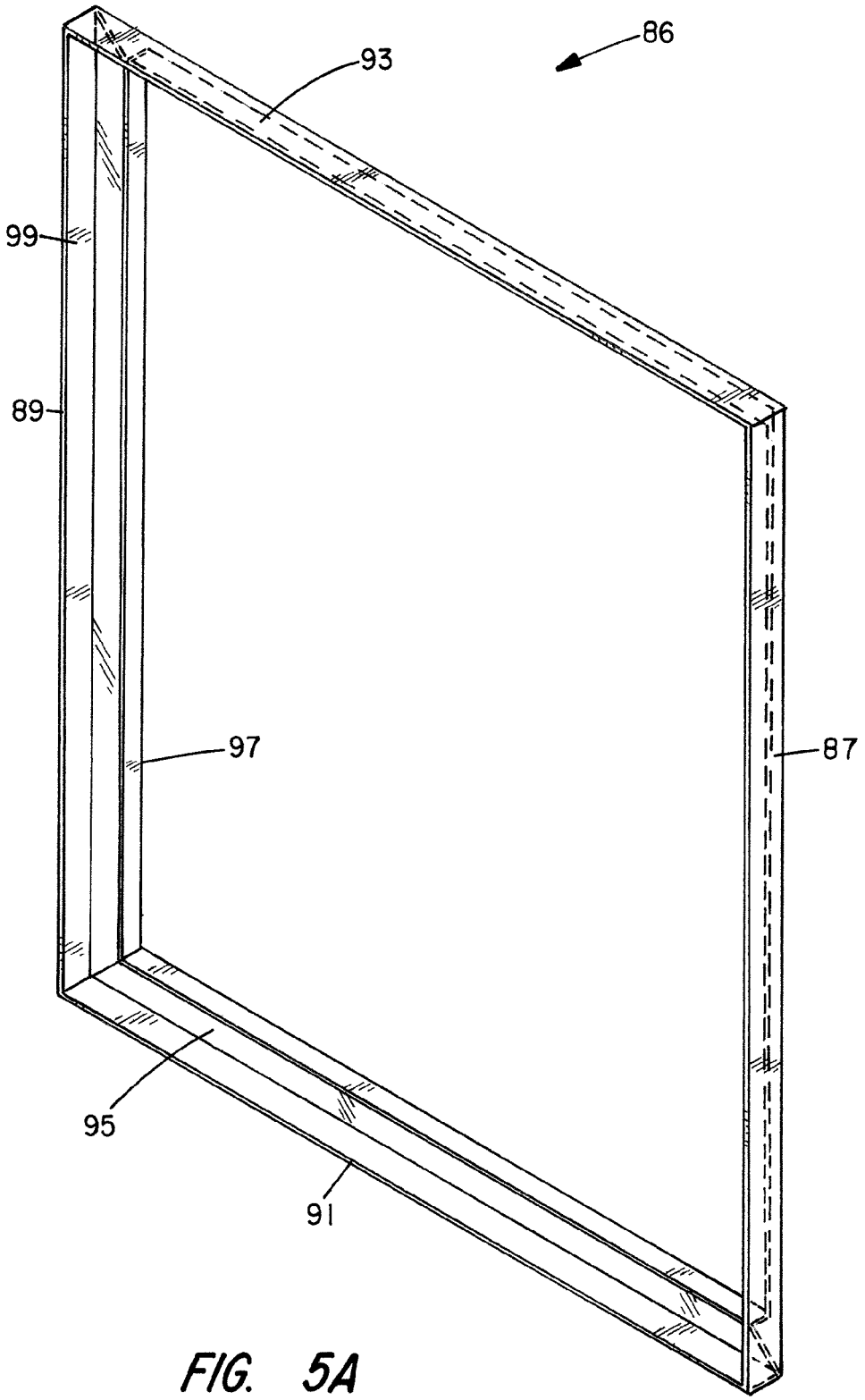
FIG. 5A is a perspective view of a drip edge assembly for the tank of FIG. 4.

FIG. 5A is a perspective view of the drip edge member. It is a welded steel assembly whose sides 87 and 89 and opposed ends 91 and 93 form a rectangular frame having a horizontally extending offset 95 with a perpendicular flange 97 projecting downward therefrom and dimensioned to closely fit to the inner wall surface of the tank 60. Projecting upward from the offset 95 is a wall surface 99 that surrounds the bottom edge portion of the shroud.

Figure 6:
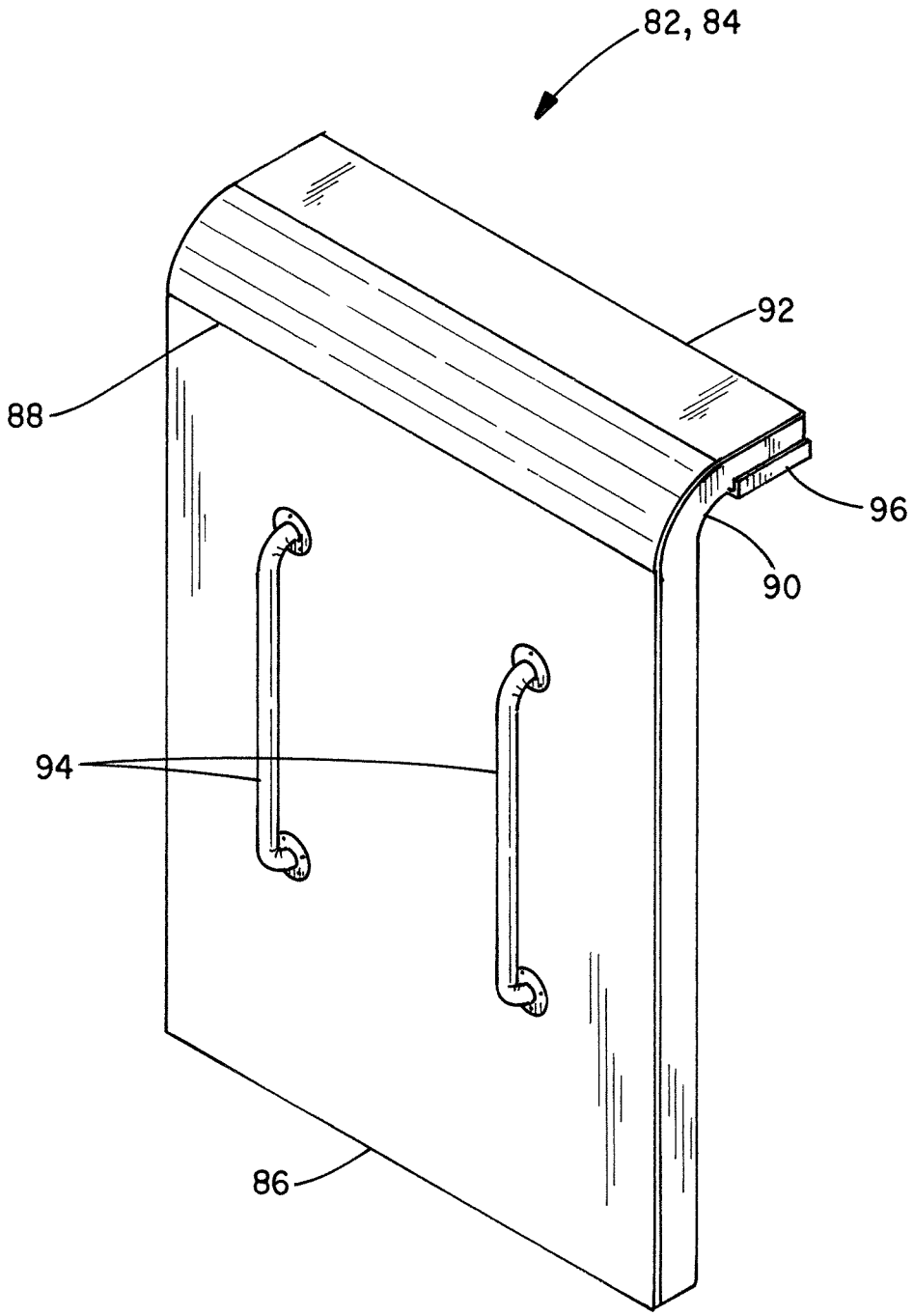
FIG. 6 is a perspective view of a spray cabinet shroud.

Referring next to FIG. 6, there is a perspective view of one of the spray shroud members 82, 84. It is seen to comprise a generally planar sheet of ¼ in. thick copoly elastomer extending from a bottom edge 86 to an upper edge 88 where it mates with a curved wrap 90 creating a 90° bend and terminating at an outer edge 92. A pair of handles 94 are bolted to the shroud as shown to facilitate lifting and carrying thereof. Also chemically welded to the horizontally extending portion of the shroud proximate the outer edge 92 are L-shaped brackets 96 on either side edge thereof. The brackets 96 provide a way whereby shroud panels on adjacent modules can be releasably joined to one another as illustrated in the view of FIG. 1.

The drip stages 18 and 20 shown in the in-line pretreatment system of FIG. 1 have a somewhat different construction than the spray stages 12, 14 and 16. They basically comprise a drip tray assembly that hooks onto the tanks of adjacent ones of the spray modules and that supports a panel having a convex curvature such that liquids dripping from the work pieces traversing the drip module and falling onto the panel will flow downhill into one or the other of two adjacent spray stages.

Figure 7:
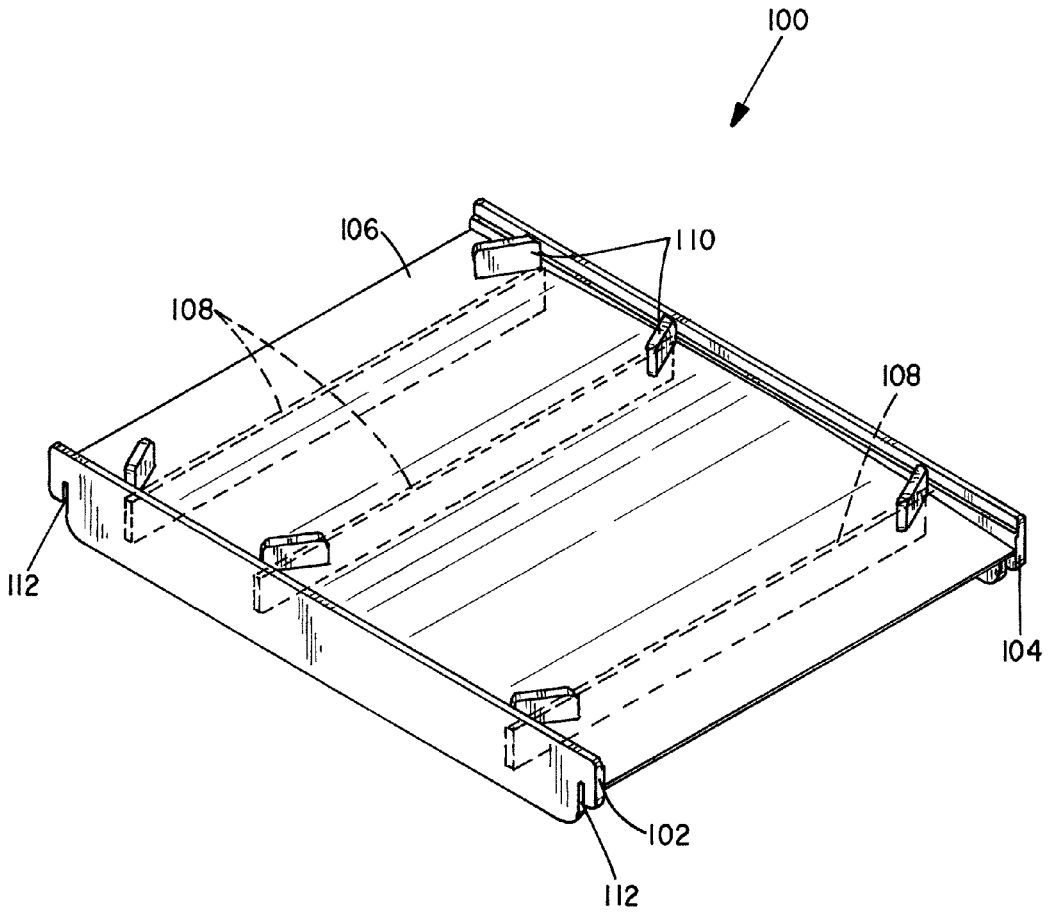
FIG. 7 is a perspective view of a tray assembly used in implementing a drip module used in the assembly of FIG. 1.

FIG. 7 is a perspective view of a drip tray assembly for a 4 ft. long drip stage 18. It is seen to comprise a left side member 102, a right side member 104 and a tray surface 106. The left and right tray sides 102 and 104 are held in parallel spaced-apart relationship by a plurality of cross braces as at 108. The sides members 102 and 104 may be fabricated from ¾ in. copoly elastomer while the cross pieces 108 may be ½ in. in thickness. The tray surface 106 may then comprise a sheet of copoly of ¼ in. thickness whereby it can be made to flex to conform to a convex curve of grooves formed inwardly along the length dimension of the left and right side members 102, 104. The convex curved sheet 106 is held in place by a plurality of standoff blocks as at 110. The stand-off blocks also serve to seat the shrouds in place on the drip modules.

With continued reference to FIG. 7, it will be seen that the left and right side members are provided with slots 112 proximate the opposed ends thereof allowing the side members 102 and 104 to fit onto the walls 99 of the drip edge member 86 of adjacent wash modules. The thickness of the side members 102 and 104 is such that they are able to support drip shrouds 114 thereon.

Figure 7A:
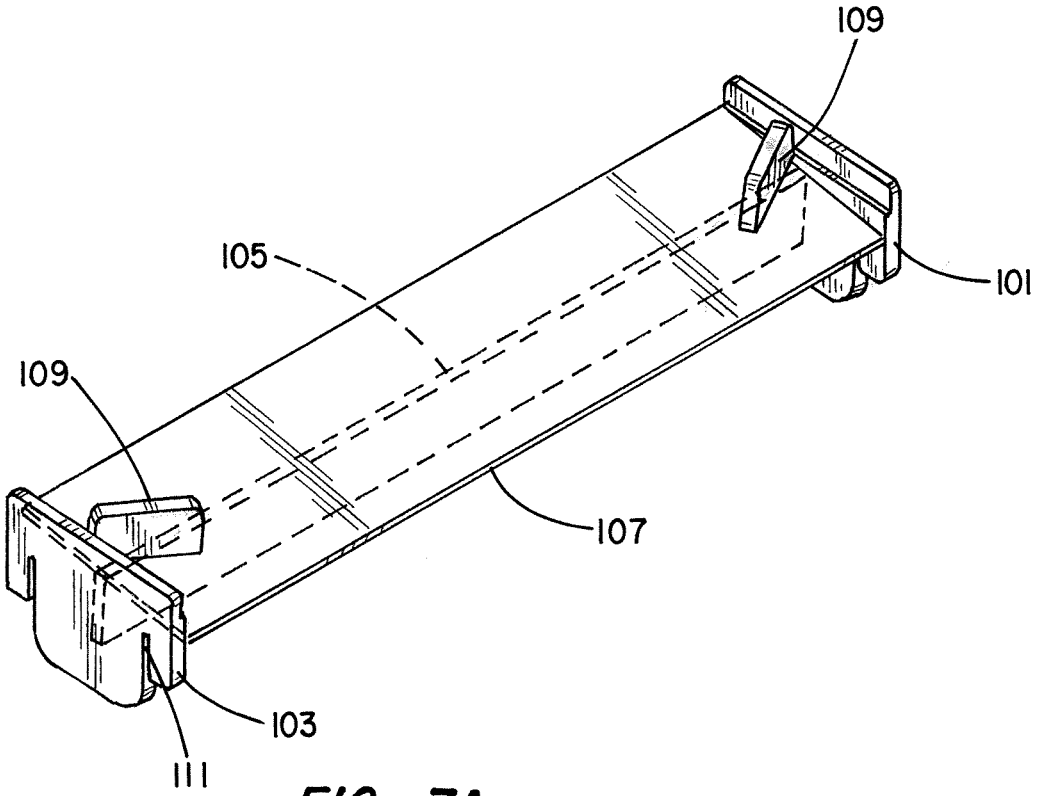
FIG. 7A is a perspective view of a short drip tray assembly.

FIG. 7A is a perspective view of a short drip tray assembly that is used when it is desired to join two wash modules, like that shown in FIG. 2, one to the other. It is designed to capture overspray and route liquid falling thereon back into the tank of the wash module with which it is coupled. It comprises side members 101 and 103 joined to one another by a cross brace 105 and supporting a sheet 107 of impervious plastic. As can be seen in FIG. 7A, the sheet 102 is inclined to the vertical supported on its opposed end edges by an angled shelf surface formed on the side members 101 and 103. Standoff blocks 109 are also provided on the short drip tray of FIG. 7A.

Like the long drip tray of FIG. 7, the right and left end members 101 and 103 have tabs defined by slots as at 111 whereby the short drip tray can be clipped onto the vertical walls of adjacent drip edge assemblies that mount to the tanks of the adjacent wash modules.

Figure 8:
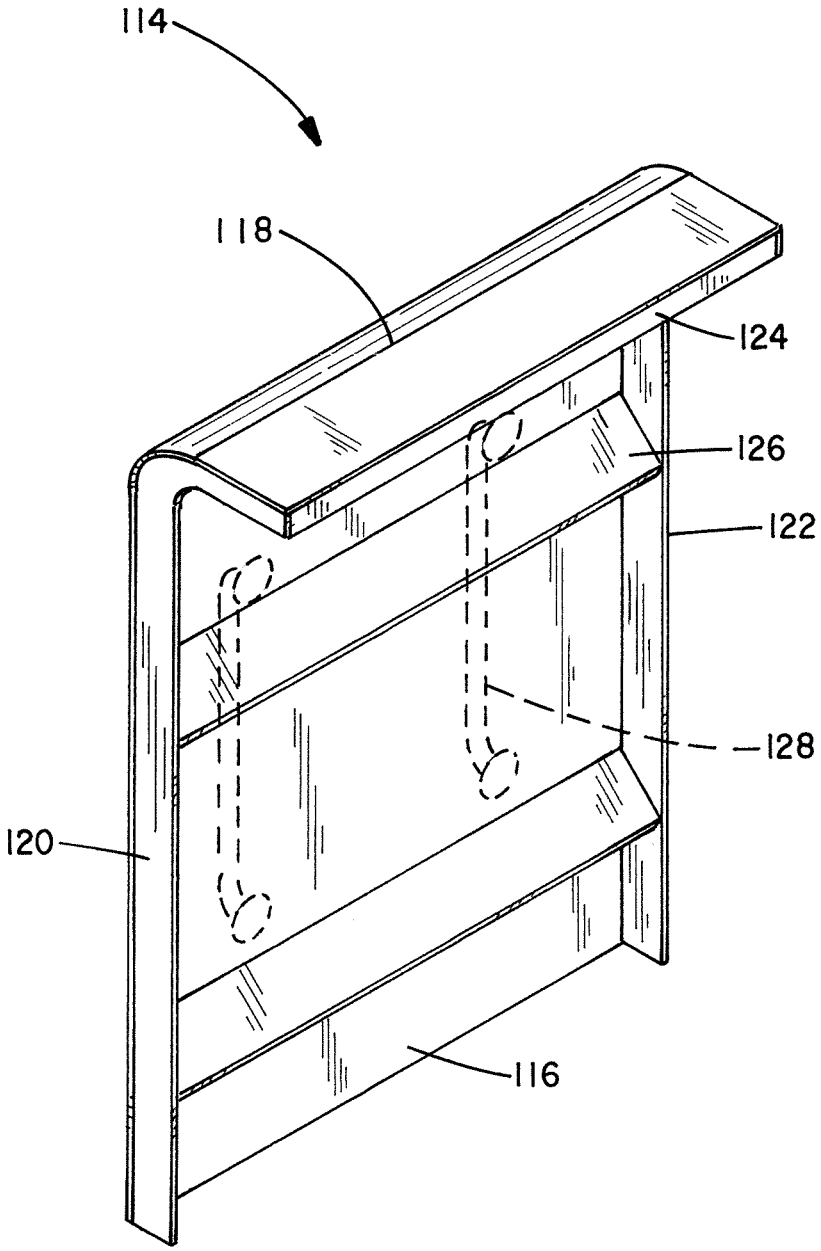
FIG. 8 is a perspective view of a shroud for a drip module component of the embodiment of FIG. 1.

FIG. 8 is a perspective view from the rear of a drip shroud 114. It is preferably fabricated from a rectangular sheet of copoly elastomer 116 having chemically welded or bonded thereto a wrap 118. Affixed to the opposed side edges of the sheet 116 and the wrap 118 are inverted, L-shaped side panels 120 and 122. A strip 124 of copoly elastomer extends from the upper end of the side member 120 to the upper end of the side member 122 and is chemically welded in place. Also affixed to the inner surface of the copoly sheet 116 are flow diverters as at 126. They are mounted with a downward slant insuring that water dripping therefrom will flow onto the convex surface 106 of the tray member 100 and from there to adjoining tanks of adjacent modules.

The drip shroud 114 also includes a pair of spaced apart, vertically oriented handles 128 that are shown in phantom line in FIG. 8.

Figure 8A:
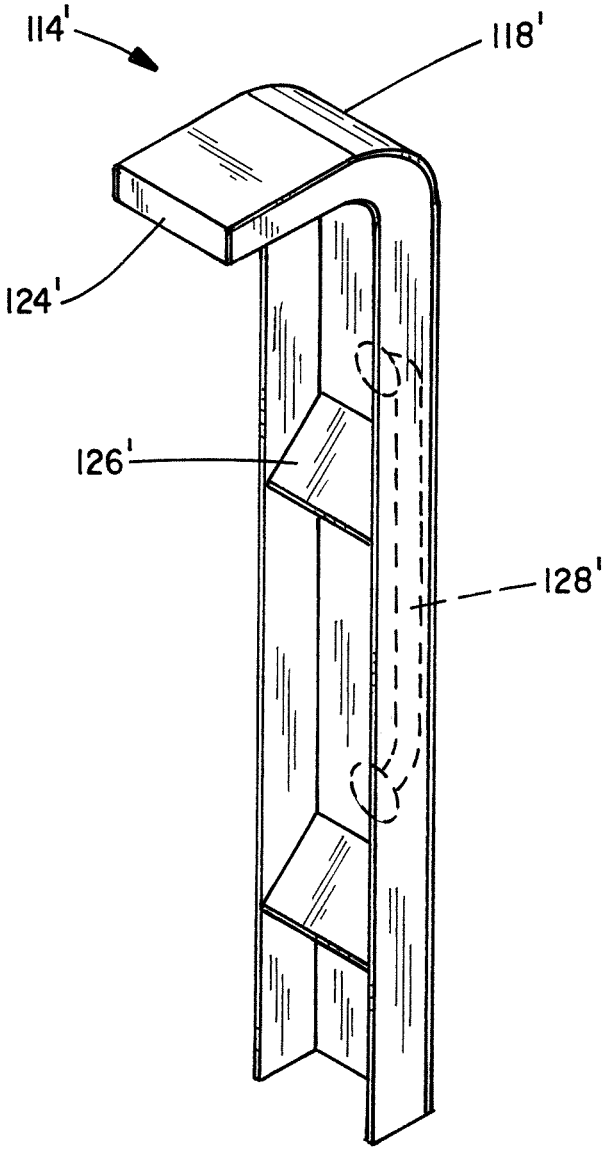
FIG. 8A is a perspective view of a shroud used with the short drip tray assembly of FIG. 7A.

FIG. 8A is a perspective view of a short drip shroud designed for use with the short drip tray of FIG. 7A. Except for its width dimension, it is substantially identical in its construction to the drip shroud of FIG. 8 and a further description of it is deemed unnecessary.

Figure 9:
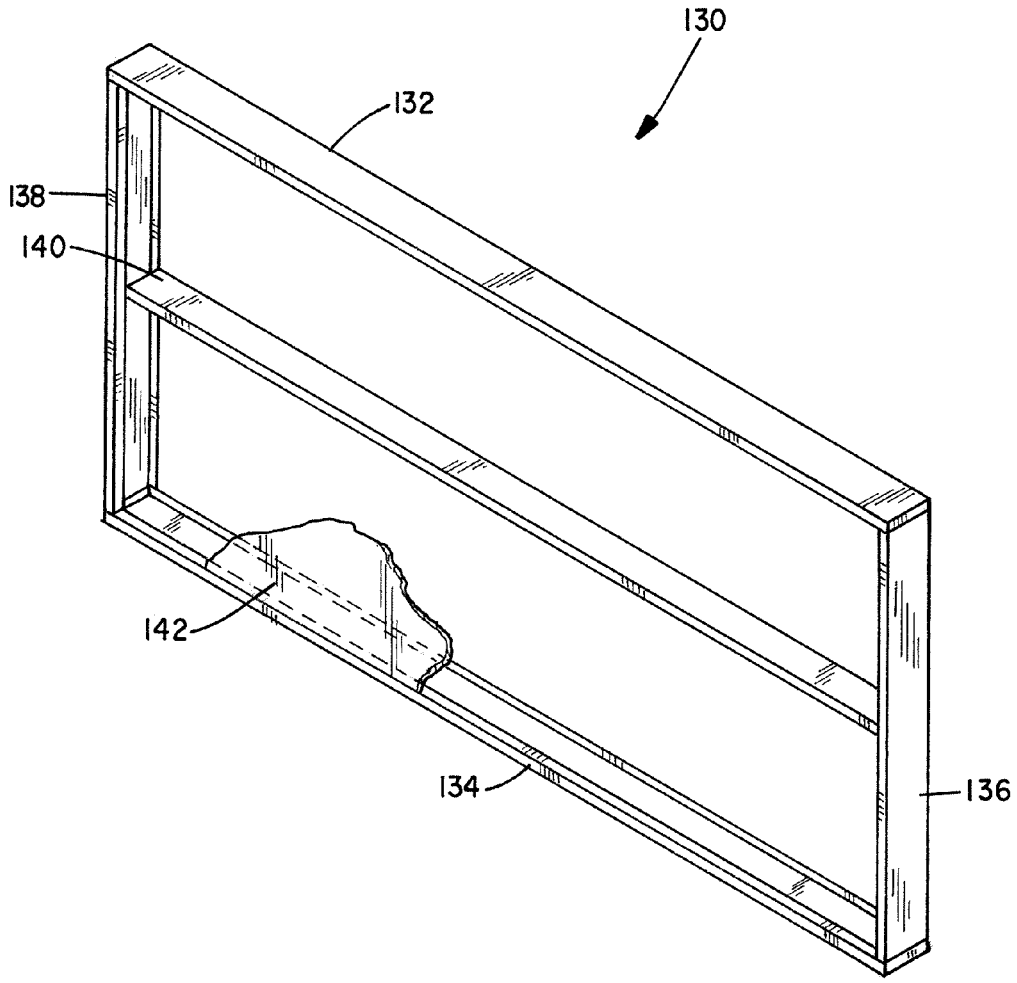
FIG. 9 is a perspective view of a filter tray used in the embodiment of the module of FIG. 2.

The wash module of FIG. 2 also illustrates the incorporation of a tray mounted filter 130 disposed above the tank 60 and arranged to trap solids which may fall from work pieces as they are being spray cleaned. FIG. 9 is a perspective view of the filter tray assembly 130. It comprises a ½ in. thick copoly elastomer frame including long side pieces 132 and 134 and short side pieces 136 and 138 along with a center brace 140. The side members 132-138 join together to form a rectangular frame on which is mounted a perforated sheet or screen 142. The filter tray 130 provides support for a suitable filter media such as a length of polypropylene batting capable of removing oily residue from the cleaning liquid as the contaminated spray passes through the filter media and the perforations of the supporting sheet 142 of the frame 130.

Figure 10:
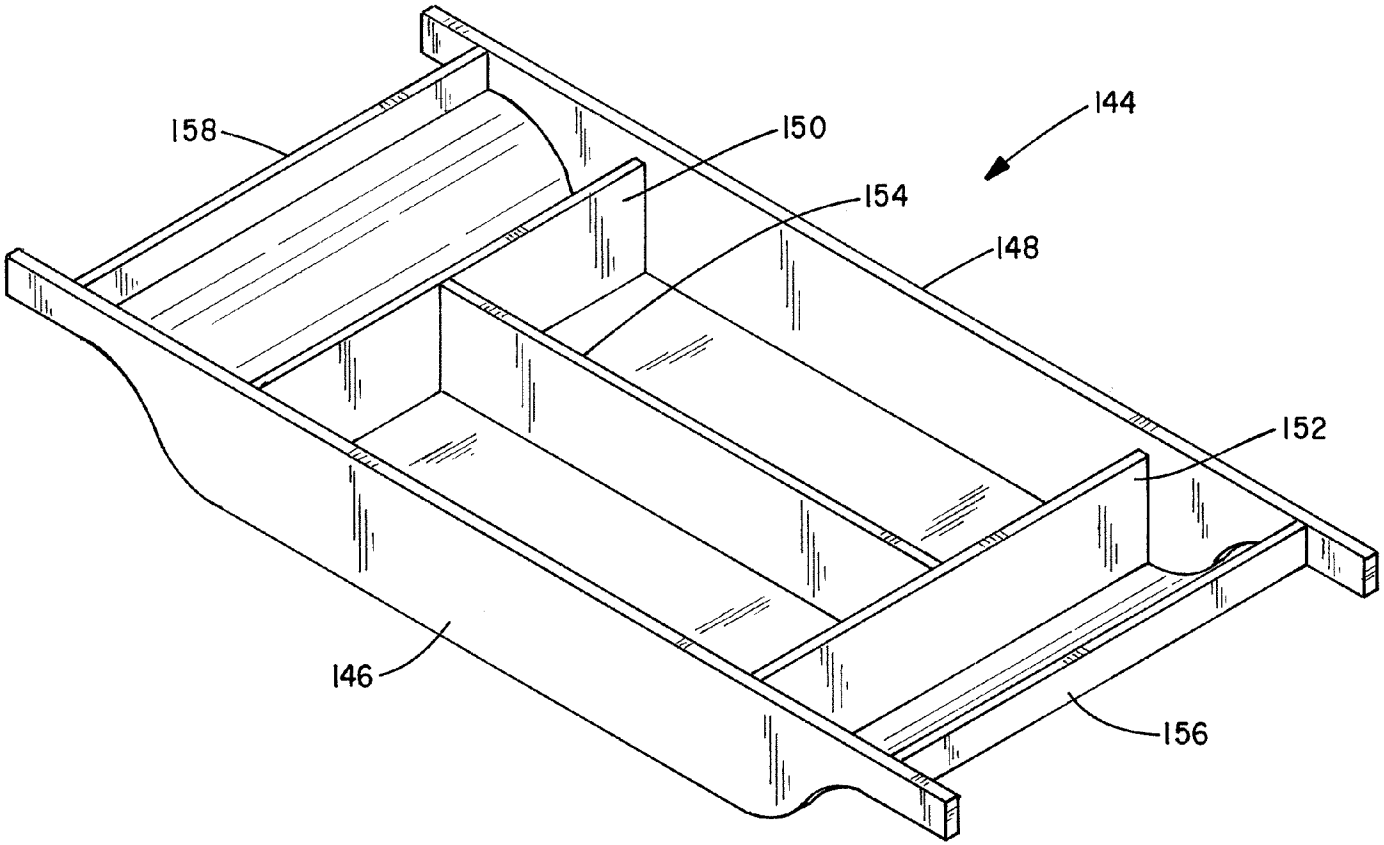
FIG. 10 is a filter tray support assembly used in implementing the wash module of FIG. 2.

The filter tray 130 is adapted to be supported by the structure 144 shown in FIG. 10. This structure is dimensioned to fit within the tank 60 and is fabricated from ¾ in. thick copoly components that are chemically welded or otherwise bonded to form the structure illustrated. It includes left and right side members 146 and 148 having a center section which may be approximately 6 in. in height and spanning approximately 27 in. in length when adapted to fit within the tank designed for a 4 ft. long wash module. The sides then curve upwards to a substantially narrower width proximate its opposed ends. The side members 146 and 148 are held apart by cross members 150 and 152 of equal length and extending between those two cross members is a center support member 154. Further cross supports 156 and 158 extend between the narrow end portions of the side members 146 and 148.

The filter tray support 144, when placed within the tank, allows the filter tray of FIG. 9 to rest upon the upper edges of the sidewalls 146 and 148, the cross members 150 and 152 and the center support member 154. Because of the manner in which the filter tray is suspended, it can be readily removed by simply sliding the tray along the upper surface of the tray support of FIG. 10 to a location where an operator may readily remove a dirty filter media and replace it with a fresh sheet thereof.

From what has been described, those skilled in the art will recognize that the present invention offers part finishers and environmentally friendly product that combines never before seen flexibility of high volume throughput with low capitol outlays and operating costs along with the ability to react to constantly changing production demands and that is capable of utilizing present day low temperature chemistries. As processes change, the in-line pretreatment system of the present invention can easily be adapted to meet customer demands. It has been shown how wash and drip modules can be easily added or removed to change the exposure time of treatment. Likewise, chemistries can easily and quickly be changed by draining a tank of a first chemistry and replacing it with another. Due to the small capacity of the tanks employed, there is less concern of exceeding local wastewater discharge permit levels. Also, the small footprint of the apparatus makes an in-line cleaning process possible in facilities where space is at a premium and known prior art devices are unable to be used because of space limitations.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A pre-washer assembly adapted for use with an external overhead conveyor, the conveyor having a coupling member adapted to carry machine parts through the pre-washer assembly for cleaning prior to their being painted or coated comprising:

(a) a plurality of concatenated wash stages, each wash stage including
  (i) a base frame assembly;
  (ii) a motor driven pump mounted to the base frame assembly and having a low pressure inlet and a high pressure outlet;
  (iii) a generally rectangular tank having opposed sidewalls and end walls extending upward from a closed bottom wall and defining an open top, said tank supported on the base frame assembly and adapted to contain a cleaning liquid, the interior of the tank being fluid coupled to the low pressure inlet;
  (iv) first and second upright assemblies attached individually to the opposed sidewalls of the tank, each of said upright assemblies including a plurality of inverted generally L-shaped uprights held in parallel, spaced-apart relation by transversely extending cross members and with a vacant gap between opposed ends of upper legs of the inverted L-shaped uprights through which the coupling member of an external overhead conveyor is adapted to pass;
  (v) first and second shrouds solely supported by, and not otherwise fastened to, said first and second upright assemblies, respectively, and with a first edge of the shrouds supported on the base frame assembly and a second edge ending at the gap;
  (vi) first and second longitudinally extending header pipes affixed individually to the first and second upright assemblies and coupled to the high pressure outlet of the motor driven pump, the header pipes supporting parallel, spaced apart, vertically extending riser pipes in fluid flow relation; and
  (vii) a plurality of spray nozzles attached along the lengths of the riser pipes.

2. The pre-washer assembly as in claim 1 and wherein the motor driven pump has an inlet coupled to the interior of the tank.

3. The pre-washer assembly of claim 1 and further including a filter tray support member disposed in the tank and a filter tray positioned atop the filter tray support member.

4. The pre-washer assembly of claim 1 and further including at least one handle affixed to each of the first and second shrouds.

5. A pre-washer assembly of claim 1 having a plurality of said wash stages coupled together, each with its predetermined gap aligned rectilinearly with an adjacent wash stage whereby the parts adapted to be carried by a coupling member of an overhead conveyor are able to traverse from one stage to an adjacent stage.

6. The pre-washer assembly of claim 5 wherein the tanks of adjacent wash stages contain differing cleaning liquids.

7. A pre-washer assembly as in claim 1 and further including:

(b) at least one drip stage disposed between adjacent ones of said wash stages, said drip stage comprising,
  (i) a drip tray having a bottom and mutually perpendicular sidewalls and end walls, the sidewalls supporting a convex arcuate top panel,
  (ii) left and right L-shaped shroud panel members of a predetermined width and having upper legs thereof coupled to the first and second shrouds of adjacent wash stages and lower legs supported by the drip tray.

8. The pre-washer assembly as in claim 1 wherein the first and second shrouds are plastic and have a handle affixed to a major surface thereof.

9. The pre-washer assembly of claim 7 wherein the first and second shrouds and the left and right L-shaped shroud panels are plastic and have a handle affixed to a major surface thereof.

10. The pre-washer assembly of claim 7 wherein the convex arcuate top panel of the drip tray causes liquids dripping from sprayed machine parts to flow to the tanks of adjacent wash stages.

11. The pre-washer assembly of claim 1 and further including a heater for heating the cleaning liquids.

12. The pre-washer assembly of claim 11 wherein the heater is electrically operated and disposed within the tank of each wash stage.

13. The pre-washer assembly of claim 1 wherein the pump is a centrifugal pump.

* * * * *